US007733300B2

(12) United States Patent
Mun et al.

(10) Patent No.: US 7,733,300 B2
(45) Date of Patent: Jun. 8, 2010

(54) PLASMA DISPLAY

(75) Inventors: Byung Jun Mun, Daegu (KR); Seung Tae Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 1406 days.

(21) Appl. No.: 10/737,820

(22) Filed: Dec. 18, 2003

(65) Prior Publication Data

US 2004/0124773 A1 Jul. 1, 2004

(30) Foreign Application Priority Data

Dec. 20, 2002 (KR) ..... 10-2002-0081945

(51) Int. Cl.
*G09G 3/28* (2006.01)
*H01J 17/49* (2006.01)

(52) U.S. Cl. ..... 345/60; 313/582

(58) Field of Classification Search ..... 345/60–68; 313/494, 498, 609, 631, 582–587, 584; 315/169.1, 315/169.4

See application file for complete search history.

(56) References Cited

U.S. PATENT DOCUMENTS

| | | | | |
|---|---|---|---|---|
| 5,877,734 | A * | 3/1999 | Amemiya | 345/60 |
| 6,075,319 | A * | 6/2000 | Kanda et al. | 313/584 |
| 6,512,337 | B2 * | 1/2003 | Hirano et al. | 315/169.4 |
| 6,714,175 | B1 * | 3/2004 | Shimada et al. | 345/60 |
| 6,819,046 | B2 * | 11/2004 | Hirano | 313/582 |
| 6,940,225 | B2 * | 9/2005 | Araki et al. | 313/582 |
| 2002/0063524 | A1 * | 5/2002 | Nakamura et al. | 313/582 |

* cited by examiner

*Primary Examiner*—Amr A. Awad
*Assistant Examiner*—Stephen G Sherman
(74) *Attorney, Agent, or Firm*—KED & Associates, LLP

(57) ABSTRACT

The inventive plasma display is capable of enhancing the luminous efficiency and the brightness by minimizing ineffective ultraviolet rays.

The plasma display according to the present invention comprises: a first transparent electrode having two or more protrusion parts; and a second transparent electrode having two or more protrusion parts corresponding respectively to the protrusion parts of the first transparent electrode. When discharges between the first and second transparent electrodes take place, there are two or more peaks in the discharge intensity of each transparent electrode.

15 Claims, 10 Drawing Sheets

PLASMA DISPLAY

BACKGROUND OF THE INVENTION

1. Field of the Invention

This invention relates to a plasma display, and more particularly to a plasma display having high luminous efficiency and brightness.

2. Description of the Related Art

A plasma display displays a picture by utilizing visible lights emitted from phosphors when ultraviolet rays generated by gas discharge excite the phosphors. The plasma display has advantages in thinness, lightness, and realizing a high resolution and large-scale screen over a cathode ray tube (CRT) that has been the mainstream display mechanism for decades.

The plasma display is composed of a plurality of discharge cells that are arranged as a matrix. According to the supplied voltage for driving, the plasma display is largely classified into a direct current DC type and an alternate current AC type, and nowadays the AC type plasma display is mainly used.

Referring to FIG. 1, there is shown a related art plasma display of a 3-electrode AC surface discharge type. The plasma display includes a front plate 10 where a picture is displayed, and a rear plate 20 separated from the front plate 10 with designated gap. The front and rear plates 10 and 20 are coupled with a frit glass.

The front plate 10 includes: a common sustain electrode Z and a scan & sustain electrode Y which are arranged in a pair for maintaining discharge lights of discharge cells through the electric discharge therebetween; a dielectric layer 12 for insulating the common sustain electrode Z and the scan & sustain electrode Y and limiting the discharge current therebetween; and a protection layer 13 for preventing the damage of the dielectric layer and improving the emission efficiency of secondary electrons.

The common sustain electrode Z includes: a transparent electrode Za made from indium-tin-oxide (ITO); a bus electrode Zb made from metal; and a black layer 14 which are formed between the transparent electrode Za and the bus electrode Zb. The black layer 14 has electrical conductivity and is made from ruthenium-oxide, lead-oxide, carbon compound, or the like.

The scan & sustain electrode Y includes: an transparent electrode Ya made from ITO; a bus electrode Yb made from metal; and a black layer B which are formed between the transparent electrode Ya and the bus electrode Yb. The black layer B has electrical conductivity and is made from ruthenium-oxide, lead-oxide, carbon compound, or the like.

The rear plate 20 includes: address electrodes X crossing the common sustain electrode Z and the scan & sustain electrode Y; a dielectric layer 22 for insulating the address electrodes X; barrier ribs 21 formed on the dielectric layer 22 to partition discharge spaces, respectively;, and a phosphor layer 23 formed on the barrier rib 21 and the dielectric layer 22 to emit visible lights of one color among the red R, green G, and blue B colors by being excited and transited by ultraviolet rays.

Discharge gases with the pressure range of 300~400 Torr are filled in the space between the front plate 10 and the rear plate 20. The discharge gases are mainly He, Xe, Ne, Ar, and the mixed gas thereof. Here, the Xe gas plays a role as the source of vacuum ultraviolet rays causing the phosphor layer 23 to emit visible lights, and the gases He, Ne, Ar and the like play a role as buffer gas.

This plasma display is mainly driven by the well-known Address and Display Separate (ADS) method in which the data writing period and the display period are separated in time.

In order to express gray levels of a picture, the plasma display is driven by frames, each of which is divided into several sub-fields having different emission frequencies with each other. Each sub-field is again divided into a reset period for uniform discharging, an address period for selecting discharge cells, and a sustain period for realizing the gray levels according to discharge frequencies. The address period corresponds to a data writing period, and the sustain period corresponds to a display period. For instance, when it is intended to display a picture of 256 gray levels, a frame interval of 1/60 second (i.e. 16.67 ms) is divided into 8 sub-fields. While the reset and address periods of each sub-field are identical for each sub-field, the sustain periods and the discharge frequencies are increased at the ratio of $2^n$ (where n=0, 1, 2, 3, 4, 5, 6 and 7) at each sub-field in accordance with the number of sustain pulses. Since the sustain period is different in each sub-field, it is possible to express a gray scale of a picture.

In the address period, when the potential difference between the scan & sustain and address electrodes Y and X reaches the range of 150~300V, a writing discharge, i.e., an address discharge, occurs at the corresponding discharge cell, and so the wall charge is accumulated on the dielectric layer 12 of the discharge cell. When an alternate current is applied between the common sustain electrode Z and the scan & sustain electrode Y at the discharge cells selected by the address discharge, a sustain discharge occurs. Within these cells, electric fields generated by the sustain discharge accelerate electrons of the discharge gases. These accelerated electrons collide with neutral particles of the discharge gases. By these collisions the neutral particles are ionized into electrons and ions. This ionization process progresses in gradually higher rate in accordance with the growing number of collisions between the ionized electrons and the neutral particles of gases. This fast ionization process consequently transforms the discharge gases into plasma with emitting vacuum ultraviolet rays (VUV) in parallel. These vacuum ultraviolet rays excite the phosphor layer 23 to generate visible lights. The generated visible lights are radiated externally through the front plate 10, so the light emission of the discharge cells, displayed pictures, can be recognized externally.

In order to express gray levels of a picture, the plasma display is driven by a time divisional method wherein each of frames is divided into several sub-fields having different emission frequencies with each other. Each sub-field is again divided into a reset period for uniform discharging, an address period for selecting discharge cells, and a sustain period for realizing the gray levels in accordance with discharge frequencies. For instance, when it is intended to display a picture of 256 gray levels, a frame interval of 1/60 second (i.e. 16.67 ms) is divided into 8 sub-fields. While the reset and address periods of each sub-field are respectively identical, the sustain periods and corresponding discharge frequencies are increased at the ratio of $2^n$ (where n=0, 1, 2, 3, 4, 5, 6 and 7) at each sub-field in accordance with the number of the sustain pulses. Since the sustain period is different in each sub-field, it is possible to determine the brightness and the chrominance of displayed pictures through a combination of the sub-fields.

The related art plasma display, however, has the problem of low luminous efficiency due to the structure of electrodes. This problem is explained in detail with reference to FIGS. 3 and 4. Referring to FIGS. 3 and 4, the transparent electrodes Za and Ya of the respective common and scan & sustain electrodes Z and Y are made from ITO on the front plate 10 in order to reduce the degradation of the aperture ratio. These transparent electrodes Za and Ya are uniformly patterned to have the width of about 300 μm. The black layer 14 and the bus electrodes Zb and Yb are stacked on the transparent electrodes Za and Ya respectively. The bus electrodes Zb and Yb of the respective common and scan & sustain electrodes Z and Y are formed on the black layer 14 and made from Ag or Cr—Cu—Cr. The black layer 14 and the bus electrodes Zb and Yb are uniformly patterned to have narrower width than those of the transparent electrodes Za and Ya. Driving signals are applied to the transparent electrodes Za and Ya via the bus electrodes Zb and Yb respectively.

When the sustain voltage is applied to one of the common sustain electrode Z and the scan & sustain electrodes Y, due to the structure of the electrodes of the front plate as set forth above, the discharge begins at the place between the transparent electrodes Za and Ya having a small gap, and spreads out along the direction of the width of electrodes as shown in FIG. 4. These sustain discharges accelerate electrons of the discharge gases. These accelerated electrons collide with neutral particles of the discharge gases. By these collisions the neutral particles are ionized into electrons and ions. Similar collisions between the ionized electrons and the neutral particles of gases continue so as to transform the discharge gases into plasma and to emit vacuum ultraviolet rays (VUV) in parallel. During the excitation and transition of the discharge gases these vacuum ultraviolet rays generated with the direction of the arrows of FIG. 4 excite the phosphor layer 23 to emit visible lights.

In the related art plasma display, however, some of the vacuum ultraviolet rays generated by the sustain discharge vanish and cannot reach the phosphor layer 23. In other words, some of the vacuum ultraviolet rays generated from the inner electric fields between the common and scan & sustain electrodes Z and Y come to be ineffective ultraviolet rays, vanishing within the electric fields of the cell and not radiating toward the phosphor layer 23. These ineffective ultraviolet rays reduce the luminous efficiency of the plasma display and the brightness of displayed pictures, and raise the power consumption by increasing discharge voltage.

SUMMARY OF THE INVENTION

Accordingly, the primary object of the present invention is to provide a plasma display that is capable of enhancing the luminous efficiency and the brightness by minimizing ineffective ultraviolet rays.

In order to achieve the objects of the invention, a plasma display according to an embodiment of the present invention comprises: a first transparent electrode having two or more protrusion parts; and a second transparent electrode having two or more protrusion parts corresponding respectively to the protrusion parts of the first transparent electrode, wherein two or more peaks in the discharge intensity of each transparent electrode occur when discharges between the first and second transparent electrodes take place.

Each transparent electrode comprises: a base part elongated in one direction; a neck part attached vertically to the base part and having the protrusion parts; a black layer formed on the base part; and a bus electrode formed on the black layer.

Each of the protrusion parts of the first and second transparent electrodes comprises: a first protrusion part horizontally elongated from both sides of the neck part and spaced with a designated gap from the base part; and a second protrusion part horizontally extended from both sides of the neck part and spaced with a designated gap from the first protrusion part.

The first and second protrusion parts have the same width.

The second protrusion part has wider width than the first protrusion part does.

The first and second protrusion parts have the same length.

The first protrusion part is longer than the first protrusion part.

The length from the end of the base part to the end of the first protrusion part is within the range from 30 to 60% of the length from the end of the base part to the end of the second protrusion part.

The length of at least one of the protrusion parts is within the range from 30 to 70% of the width of a discharge cell.

According to another embodiment of the present invention, a plasma display having a pair of transparent electrodes in a discharge cell, wherein each transparent electrode comprises: a base part elongated in one direction; a neck part attached vertically to the base part; a first protrusion part attached to the neck part so as to locate near the border area of the discharge cell; and a second protrusion part attached to the neck part so as to locate near the border area of the discharge cell, wherein the length from the end of the base part to the end of the first protrusion part is within the range from 30% to 60% of the length from the end of the base part to the end of the second protrusion part.

According to yet another embodiment of the present invention, a plasma display having a pair of transparent electrodes in a discharge cell, wherein each transparent electrode comprises: a base part elongated in one direction; a neck part attached to the base part at a right angle; a first protrusion part attached to the neck part so as to locate near the border area of the discharge cell; and a second protrusion part attached to the neck part so as to locate near the border area of the discharge cell, wherein the length of at least one of the first and second protrusion parts is within the range from 30 to 70% of the width of the discharge cell.

BRIEF DESCRIPTION OF THE DRAWINGS

The object and advantages of the invention will be apparent from the following detailed description of the embodiments of the present invention with reference to the accompanying drawings, in which.

DETAILED DESCRIPTION OF THE PREFERRED EMBODIMENT

Hereinafter, the embodiments of the present invention will be explained in detail with reference to accompanying FIGS. 5 to 10.

Figure 1:
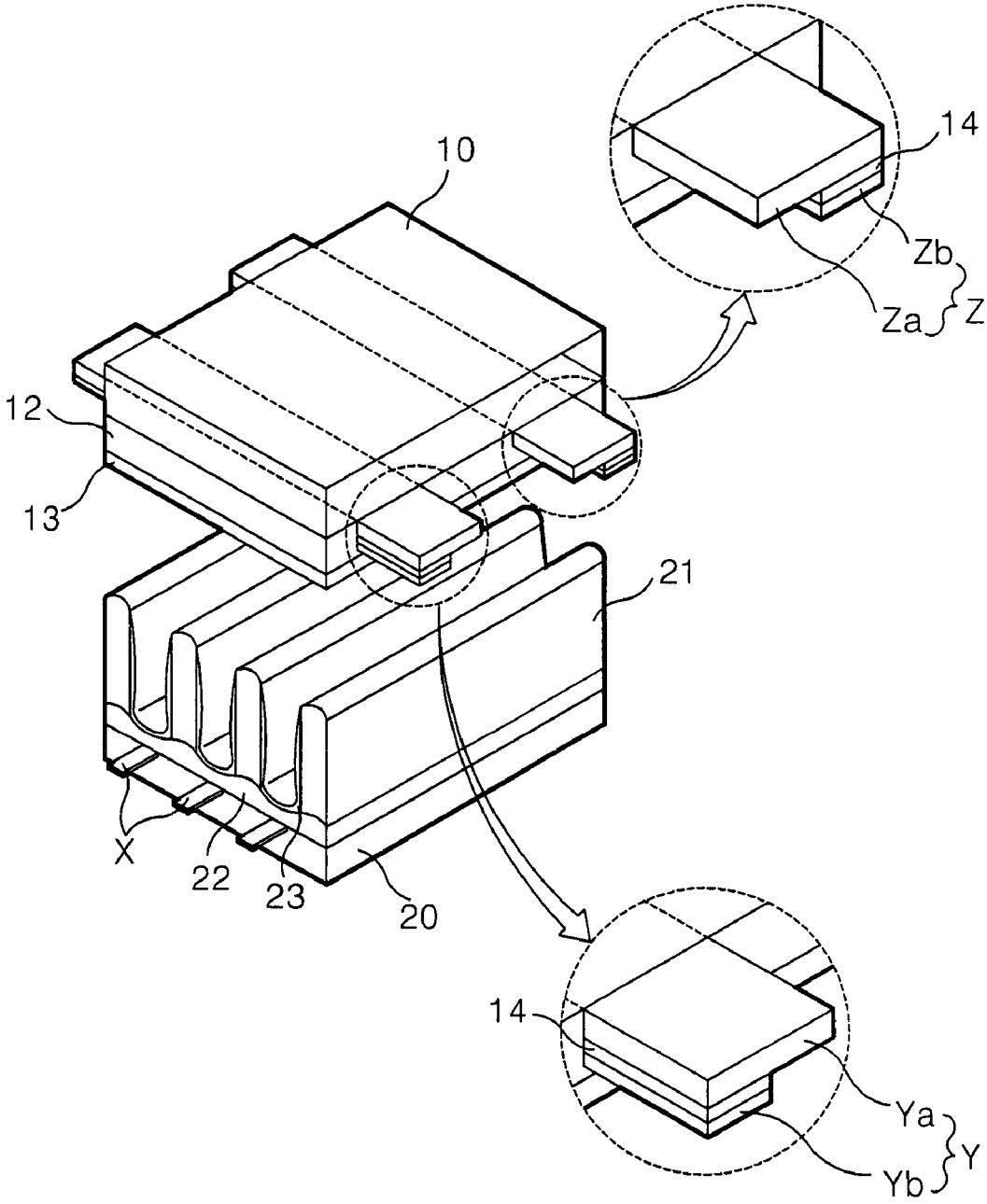
FIG. 1 RELATED ART
FIG. 1 is a perspective view showing a related art plasma display.
Figure 2:
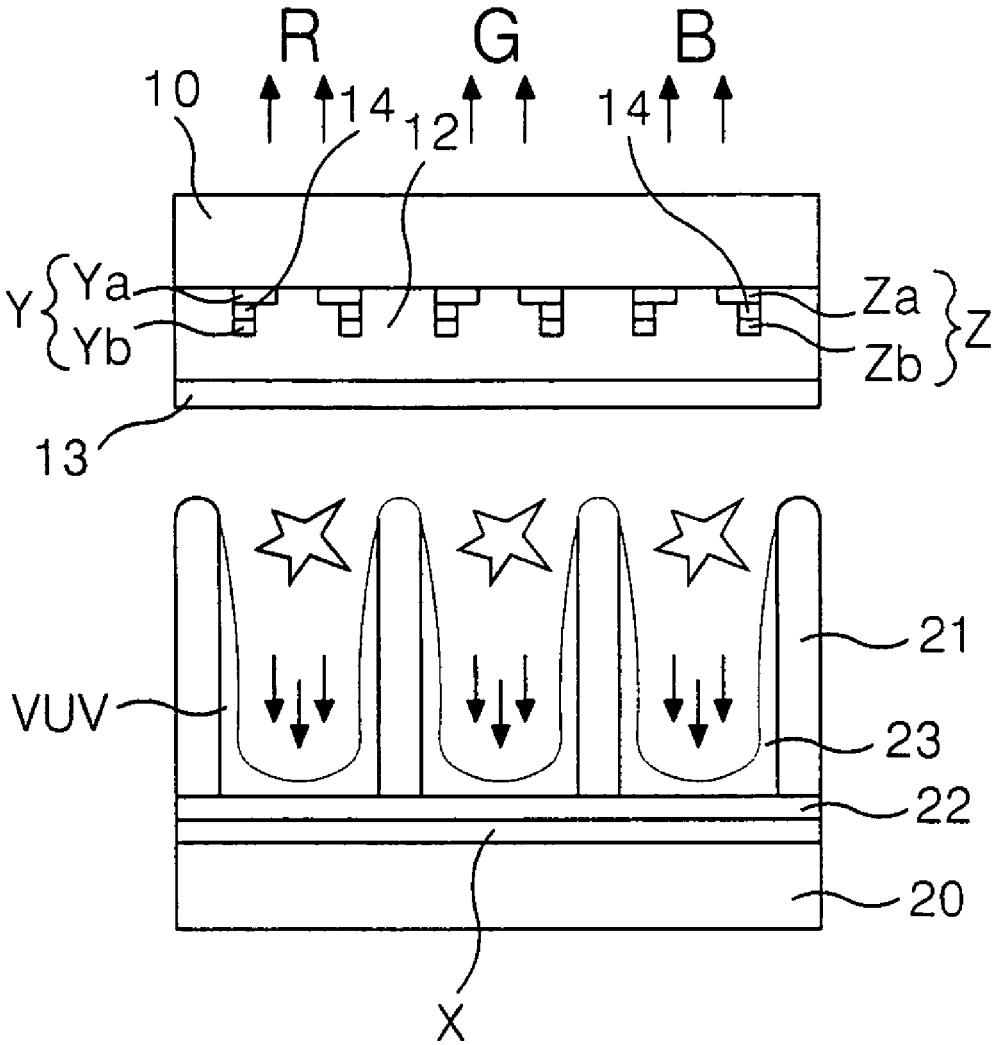
FIG. 2 is a section view showing the plasma display of FIG. 1.
Figure 3:
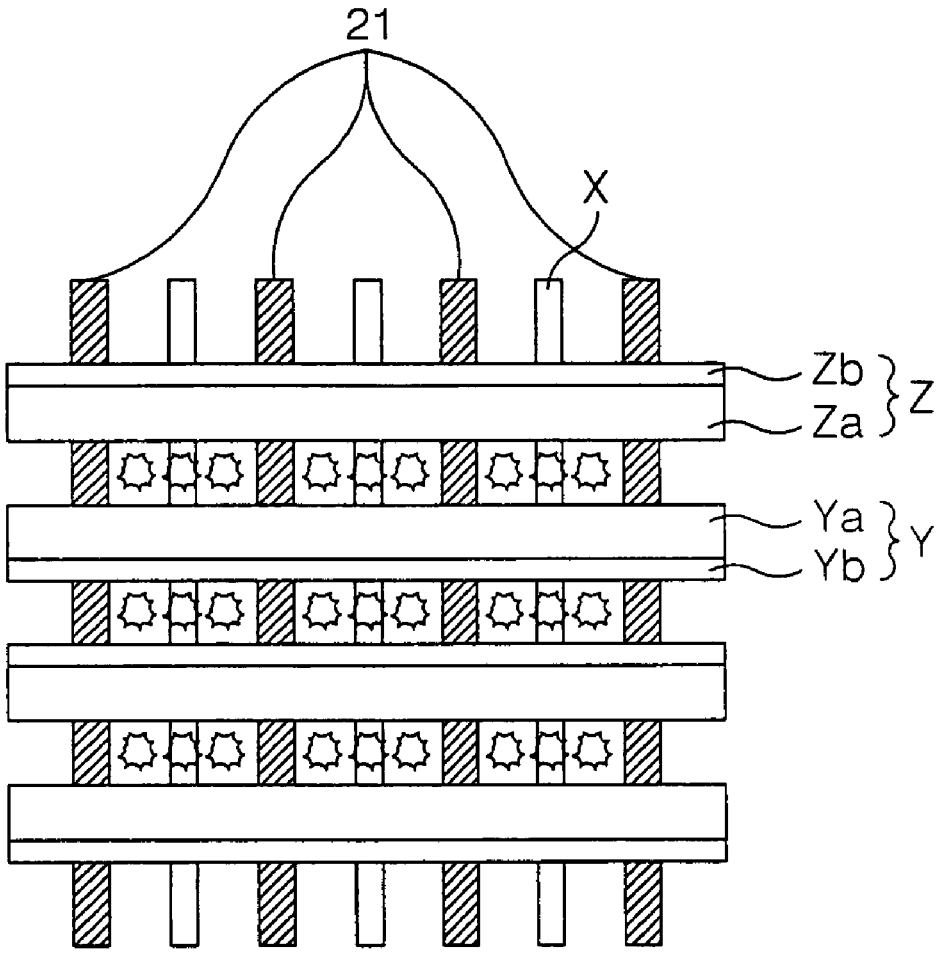
FIG. 3 is a plane view showing the plasma display of FIG. 1.
Figure 4:
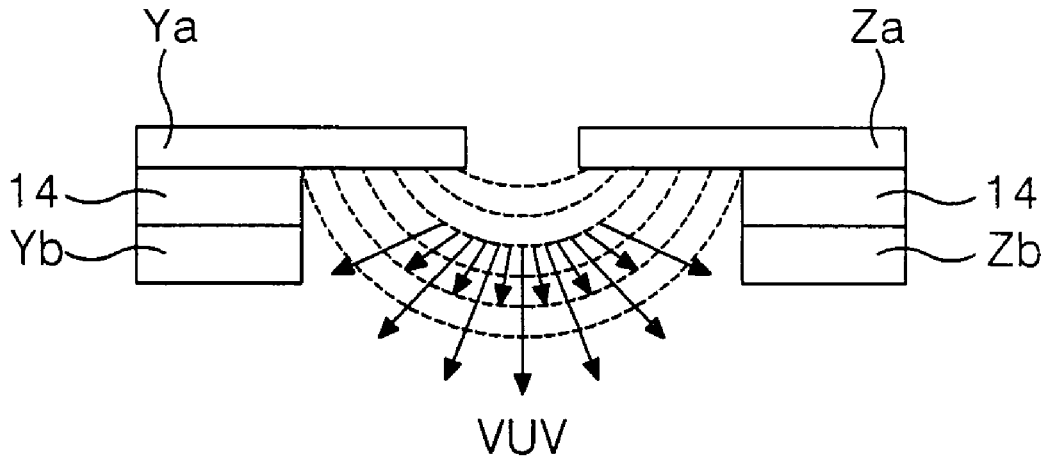
FIG. 4 is a section view showing the electric fields and the vacuum ultraviolet rays between the common and scan & sustain electrodes Z and Y of FIG. 1.
Figure 5:
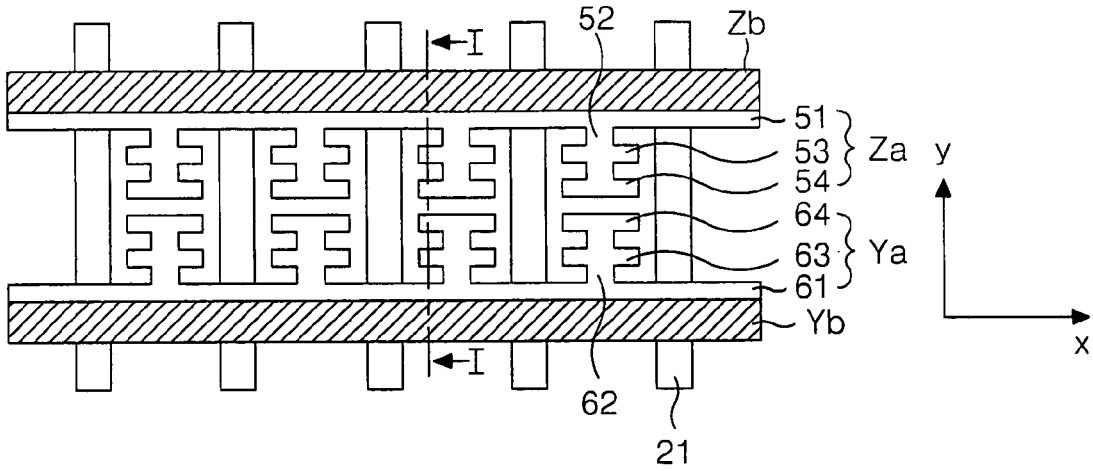
FIG. 5 is a plane view showing pairs of electrodes of the front plate of a plasma display according to the first embodiment of the present invention.
Figure 6:
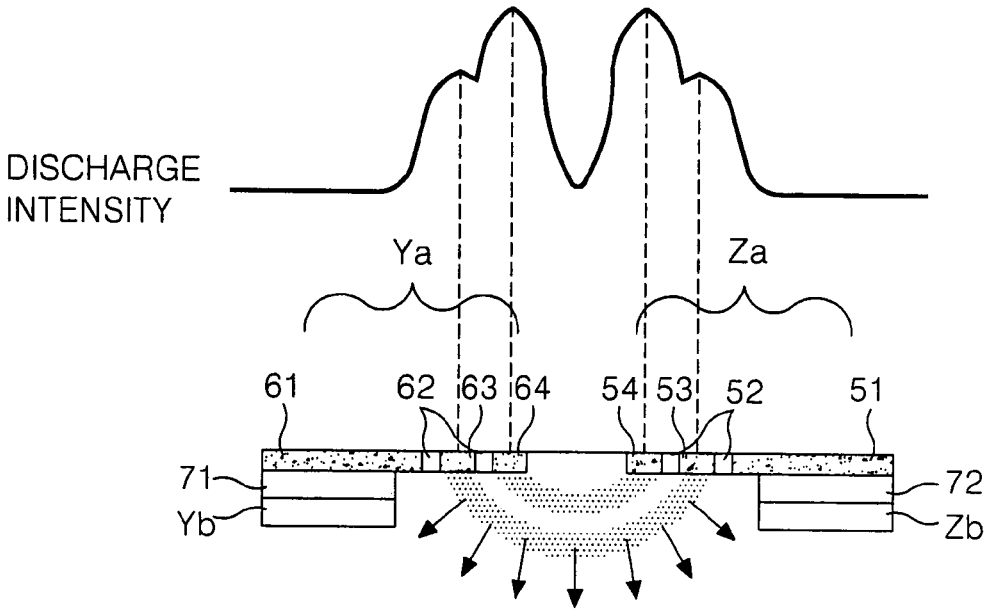
FIG. 6 is a section view showing the pair of electrodes of the front plate of a plasma display cut along the line I-I shown in FIG. 5.

FIG. 5 is a plane view showing pairs of electrodes of the front plate of a plasma display according to the first embodiment of the present invention. In FIG. 5, the structure of the rear plate of the plasma display is essentially the same as the one shown in FIG. 1, and the detailed description thereof will be omitted herein. FIG. 6 is a section view showing the pair of electrodes of the front plate, cut along the line I-I shown in FIG. 5.

Referring to FIGS. 5 and 6, a plasma display according to the first embodiment of the present invention includes a pair of transparent electrodes Ya and Za. The transparent electrode Za has a neck part 52 and protrusion parts 53 and 54. Similarly, the transparent electrode Ya has a neck part 62 and protrusion parts 63 and 64.

The neck part 52 of the transparent electrode Za is attached to a base part 51, at the half (½) position of the width of a discharge cell, and extended toward the horizontal direction of the base part 51, i.e. y-axis direction. Similarly, the neck part 62 of the transparent electrode Ya is attached to a base part 61, at the half (½) position of the width of a discharge cell, and extended toward the horizontal direction of the base part 61, i.e. y-axis direction.

The base parts 51 and 61 are formed to elongate toward the crossed direction with the address electrode and a barrier rib 21, i.e. x-axis direction and have constant widths, respectively.

A black layer 72 and a bus electrode Zb are stacked in sequence on the base part 51. A black layer 71 and a bus electrode Yb are stacked in sequence on the base part 61. The neck part 52 forms a current path between the base part 51 and the protrusion parts 53 and 54. Also, the neck part 62 forms a current path between the base part 61 and the protrusion parts 63 and 64.

The first protrusion parts 53 and 63 of the transparent electrodes Za and Ya are attached to the middle region of the neck parts 52 and 62 and are projected from both sides of the neck parts 52 and 62 toward the longitudinal direction of the base parts 51 and 61, namely x-axis direction, respectively.

The second protrusion parts 54 and 64 of the transparent electrodes Za and Ya are attached to the ends of the neck parts 52 and 62 and are projected from both sides of the neck parts 52 and 62 toward the longitudinal direction of the base parts 51 and 61, namely x-axis direction, respectively.

A designated gap is maintained between the base part 51 and the first protrusion part 53, and between the base part 61 and the first protrusion part 63. Another designated gap is maintained between the first and second protrusion parts 53 and 54, and between the first and second protrusion parts 63 and 64. Yet another designated gap is maintained between the second protrusion part 54 of the common sustain electrode Z and the second protrusion part 64 of the scan & sustain electrode Y.

These transparent electrodes Za and Ya are made from ITO and formed on the front plate. The black layers 71 and 72 are formed respectively on the base parts 61 and 51 of the transparent electrodes Ya and Za, and have electrical conductivity and are made from ruthenium-oxide, lead-oxide, carbon compound, or the like. The bus electrodes Zb and Yb are made from Ag or Cr—Cu—Cr and formed on the black layers 72 and 71, respectively. The width of both the black layers 71 and 72 and the bus electrodes Zb and Yb is smaller than that of the base parts 51 and 61 of the transparent electrodes Za and Ya.

On the other hand, on the front plate of this plasma display, a dielectric layer is formed so as to cover the common sustain electrode and the scan & sustain electrode, and a protection layer is formed on the dielectric layer. The rear plate of this plasma display is essentially the same as the one shown in FIG. 1.

Figure 7:
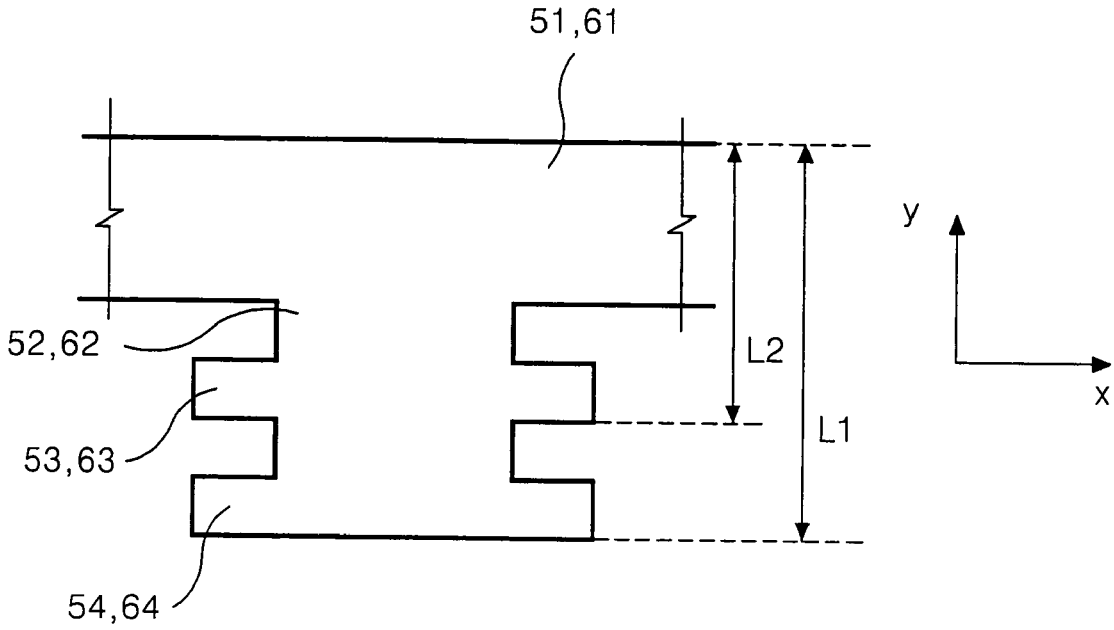
FIG. 7 is a view showing the relationship between the distance from the base part to a first protrusion part and the distance from the base part to a second protrusion part shown in FIG. 5.
Figure 8:
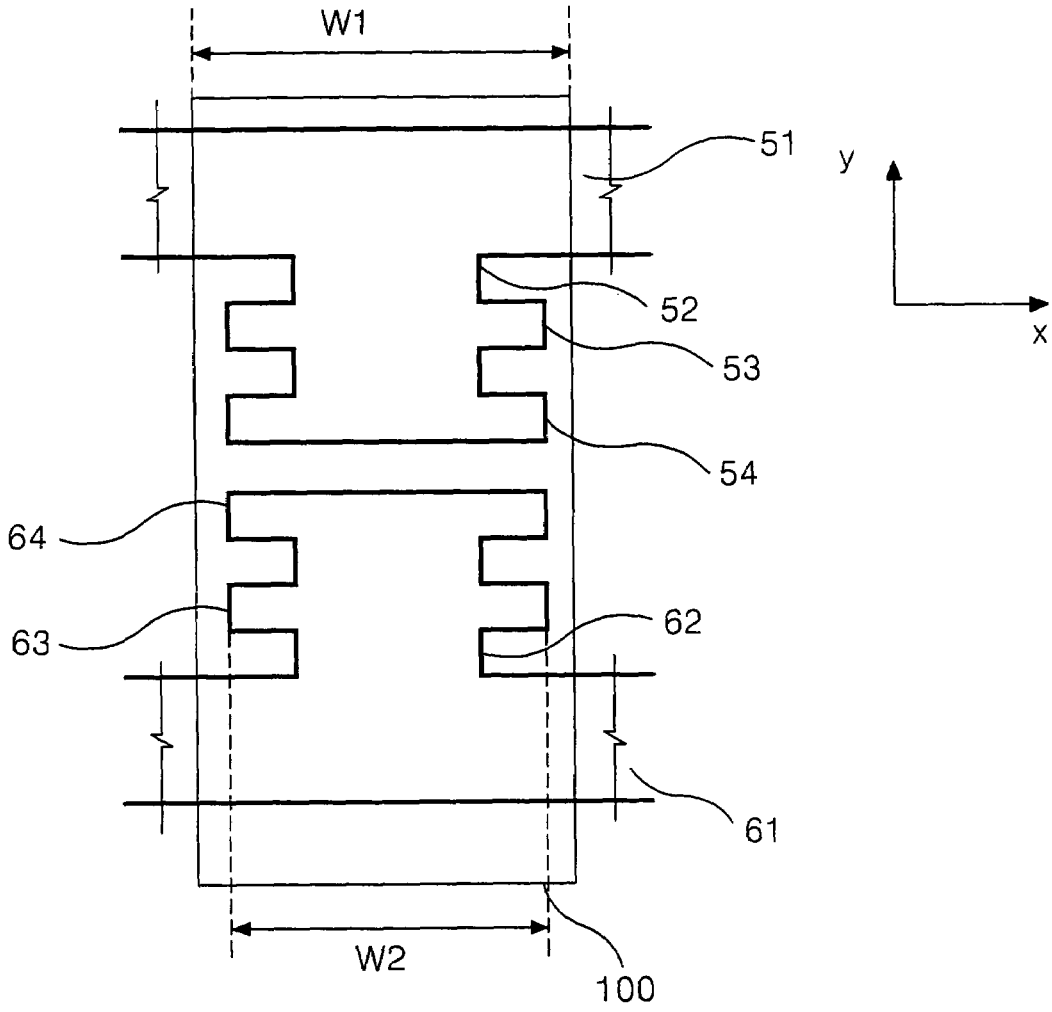
FIG. 8 is a view showing the relationship between the length of the protrusion part and the width of the discharge cell in FIG. 5.

FIGS. 7 and 8 are views showing the sizes of the protrusion parts 53, 63, 54 and 64 of the transparent electrodes Ya and Za.

Referring to FIGS. 7 and 8, in consideration of the luminous efficiency and transmittance of light, the length L2 from the end of the base part 51 or 61 to the end of the first protrusion part 53 or 63 should be within the range from 30% to 60% of the length L1 from the end of the base part 51 or 61 to the end of the second protrusion part 54 or 64, in the width direction of the base part 51 or 61, i.e., the x-axis direction shown in FIG. 7. In addition, the end-to-end length W2 of the protrusion part 53, 63, 54, or 64 should be within the range from 30% to 70% of the width W1 of the discharge cell, in the longitudinal direction of the base part 51 or 61, i.e., the y-axis direction shown in FIG. 8.

When the sustain voltage is applied to either the common sustain electrode or the scan & sustain electrode, as shown in FIG. 6, a strong discharge takes place between the second protrusion part 54 of the common sustain electrode Z and the second protrusion part 64 of the scan & sustain electrode Y to cause the sustain discharge. Another strong discharge takes place between the first protrusion part 53 of the common sustain electrode Z and the first protrusion part 63 of the scan & sustain electrode Y immediately after or nearly simultaneously with the discharge between the second protrusion parts 54 and 64. During this process, the concentrated currents between the first protrusion parts 53 and 63 and between the second protrusion parts 54 and 64 result in driving strong electric fields between the first protrusion parts 53 and 63 and between the second protrusion parts 54 and 64. Consequently, the amount of the vacuum ultraviolet rays increases owing to the concentrated discharges between the first protrusion parts 53 and 63 and between the second protrusion parts 54 and 64. Peaks in the discharge intensity occur at the positions corresponding to the first protrusion parts 53 and 63 and the second protrusion parts 54 and 64. In particular, the discharge between the second protrusion parts 54 and 64 is stronger than that between the first protrusion parts 53 and 63, because the gap between the second protrusion parts 54 and 64 is narrower than that between the first protrusion parts 53 and 63. The vacuum ultraviolet rays accompanied with the concentrated plasma discharges occurring between the first protrusion parts 53 and 63 and between the second protrusion parts 54 and 64 excite and transform the phosphors of the rear plate to emit visible lights.

As explained above, the plasma display according to the present invention has two or more protrusion parts at each transparent electrode in the discharge cell, and generates concentrated discharges centered at the two or more protrusion parts. These concentrated discharges occurring at two or more regions of each transparent electrode increase the amount of the vacuum ultraviolet rays. So, the plasma display according to the present invention can have larger amounts of the vacuum ultraviolet rays for exciting the phosphors to emit lights than the related art plasma display does, even if the same voltage is applied to the common and the scan & sustain electrode for cell discharge.

Figure 9:
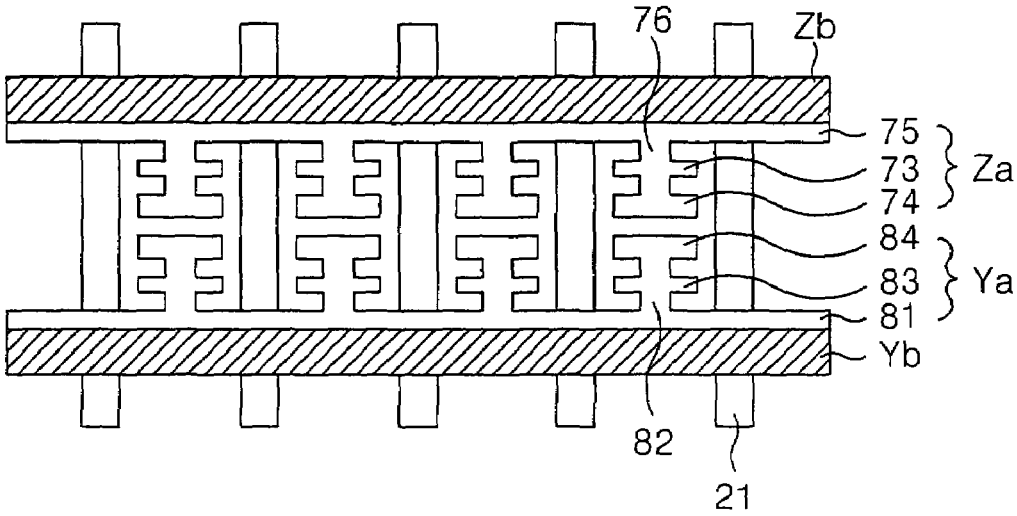
FIG. 9 is a plane view showing pairs of electrodes of the front plate of a plasma display according to the second embodiment of the present invention.

FIG. 9 is a plane view showing pairs of electrodes of the front plate of a plasma display according to the second embodiment of the present invention. The rear plate of this plasma display is essentially the same as the one shown in FIG. 1.

Referring to FIG. 9, the plasma display according to the second embodiment of the present invention includes a pair of transparent electrodes Za and Ya having a first protrusion parts 73 and 83 and a second protrusion parts 74 and 84, wherein the width of the respective second protrusion parts 74 and 84 is greater than that of the first protrusion parts 73 and 83.

The protrusion parts 73 and 74 of the transparent electrode Za are horizontally extended with a designated gap therebetween from both sides of the neck part 76 attached to the base part 75. Similarly, the protrusion parts 83 and 84 of the transparent electrode Ya are horizontally extended with a designated gap therebetween from both sides of the neck part 82 attached to the base part 81.

The inter-electrode distance between Z and Y at the second protrusion parts 74 and 84 is narrower than that at the first protrusion parts 73 and 83. So, the discharge between the second protrusion parts 74 and 84 gets stronger than that between the first protrusion parts 73 and 83. In addition, as the width of the second protrusion parts 74 and 84 becomes greater, the plasma discharge therebetween becomes stronger. Consequently, more vacuum ultraviolet rays generate between the second protrusion parts 74 and 84.

Figure 10:
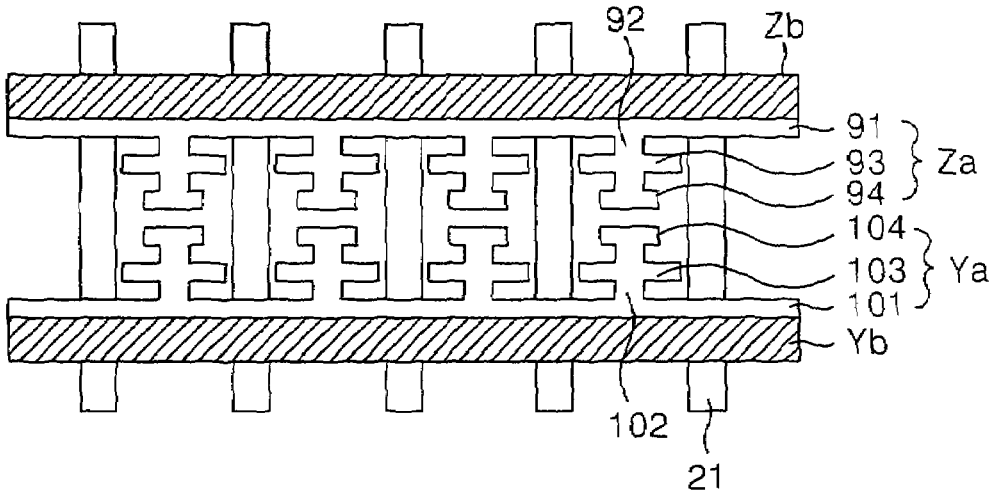
FIG. 10 is a plane view showing pairs of electrodes of the front plate of a plasma display according to the third embodiment of the present invention.

FIG. 10 is a plane view showing pairs of electrodes of the front plate of a plasma display according to the third embodiment of the present invention. The rear plate of this plasma display is essentially the same as the one shown in FIG. 1.

Referring to FIG. 10, the plasma display according to the third embodiment of the present invention includes a pair of transparent electrodes Za and Ya having protrusion parts, wherein a first protrusion part 93 or 103 is longer than a second protrusion part 94 or 104.

The protrusion parts 93 and 94 of the transparent electrode Za are horizontally extended with a designated gap therebetween from both sides of the neck part 92 attached to the base part 91. The protrusion parts 103 and 104 of the transparent electrode Ya are horizontally extended with a designated gap therebetween from both sides of the neck part 102 attached to the base part 101.

As the first protrusion parts 93 and 103 become longer so that these are near to the border area of the discharge cell, the plasma discharge between the first protrusion parts 93 and 103 becomes stronger. Consequently, the efficient utilization of the entire space of the discharge cell is possible.

As explained above in detail, the plasma display according to the present invention has two or more protrusion parts at a transparent electrode so as to have two or more peaks in the discharge intensity. This contributes to enhance the luminous efficiency and the brightness of the plasma display.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display, comprising:

a first transparent electrode having at least two protrusion parts; and a second transparent electrode having at least two protrusion parts corresponding respectively to the protrusion parts of the first transparent electrode, wherein each transparent electrode comprises:

a base part elongated in one direction;

a neck part attached vertically to the base part and extending in a first direction, the neck part having the respective protrusion parts extending therefrom;

a black layer formed on the base part; and a bus electrode formed on the black layer, wherein each of the protrusion parts of the first and second transparent electrodes comprises:

a first protrusion part horizontally extended from both sides of the neck part along a first axis in a second direction that traverses the first direction, the first protrusion part being spaced with a designated gap from the base part; and a second protrusion part extended from both sides of the neck part along a second axis in the second direction and the second protrusion part being spaced with a designated gap from the first protrusion part, wherein a width of the second protrusion part of the first transparent electrode in the first direction is wider than a width of the first protrusion part of the first transparent electrode in the first direction.

2. The plasma display according to claim 1, wherein a discharge intensity of each transparent electrode includes two or more peaks when discharges between the first and second transparent electrodes take place.

3. The plasma display according to claim 1, wherein the first and second protrusion parts of the first transparent electrode have a same length in the second direction.

4. The plasma display according to claim 1, wherein the second protrusion part of one transparent electrode faces the second protrusion part of another transparent electrode for one discharge cell.

5. The plasma display according to claim 1, wherein only two protrusion parts are attached to each neck part.

6. A plasma display having a pair of transparent electrodes in a discharge cell, wherein each transparent electrode comprises:

a base part elongated in one direction;

a neck part attached vertically to the base part and extending in a first direction;

a first protrusion part attached to the neck part so as to be located near a border area of the discharge cell, the first protrusion part extending along a second direction; and a second protrusion part attached to the neck part so as to be located near a central area of the discharge cell, the second protrusion part extending along the second direction, wherein a width of the second protrusion part of the one of the transparent electrodes in the first direction is wider than a width of the first protrusion part of the one of the transparent electrodes in the first direction.

7. The plasma display according to claim 6, wherein the first and second protrusion parts of the one of the transparent electrodes have a same length.

8. The plasma display according to claim 6, wherein a discharge intensity of each transparent electrode includes at least two peaks during discharges between the first and second transparent electrodes.

9. The plasma display according to claim 6, wherein the second protrusion part of the one of the transparent electrodes faces the second protrusion part of the other one of the transparent electrodes for one discharge cell.

10. The plasma display according to claim 6, wherein only two protrusion parts are attached to the neck part for each of the transparent electrodes.

11. A plasma display having a pair of transparent electrodes in a discharge cell, wherein each transparent electrode comprises:

a base part elongated in one direction;

a neck part attached to the base part at a right angle and extending along a first direction;

a first protrusion part attached to the neck part so as to be located near a border area of the discharge cell, the first protrusion part extending along a second direction that transverses the first direction; and a second protrusion part attached to the neck part so as to be located near a central area of the discharge cell, the second protrusion part extending along the second direction, wherein a width of the second protrusion part of the one of the transparent electrodes in the first direction is wider than a width of the first protrusion part of the one of the transparent electrodes in the first direction.

12. The plasma display according to claim 11, wherein the first and second protrusion parts of the one of the transparent electrodes have a same length in the second direction.

13. The plasma display according to claim 11, wherein a discharge intensity of each transparent electrode includes at least two peaks when discharges occur between the transparent electrodes.

14. The plasma display according to claim 11, wherein the second protrusion part of the one of the transparent electrodes faces the second protrusion part of another one of the transparent electrodes for one discharge cell.

15. The plasma display according to claim 11, wherein only two protrusion parts are attached to the neck part for each of the transparent electrodes.

* * * * *